United States Patent [19]

Smith

[11] Patent Number: 5,027,633

[45] Date of Patent: Jul. 2, 1991

[54] BOX MAKERS FORMS

[75] Inventor: Leonard Smith, Hollywood, England

[73] Assignee: Deritend Engineering Limited, England

[21] Appl. No.: 516,736

[22] Filed: Apr. 30, 1990

[30] Foreign Application Priority Data

May 16, 1989 [GB] United Kingdom ..... 8911180

[51] Int. Cl.[5] ..... B21D 9/08

[52] U.S. Cl. ..... 72/213; 72/390; 72/413; 72/448

[58] Field of Search ..... 72/212, 213, 390, 398, 72/413, 481, 389, 446, 448; 76/101.1, 107.4, 107.8; 83/927; 269/900

[56] References Cited

U.S. PATENT DOCUMENTS

| | | | |
|---|---|---|---|
| 96,695 | 11/1869 | Havell | 72/212 |
| 450,241 | 4/1891 | Lavery | 72/390 |
| 2,339,855 | 1/1944 | Hodil et al. | 72/213 |
| 3,033,267 | 5/1962 | Mason | 72/213 |
| 3,271,990 | 9/1966 | Mitchell | 72/389 |
| 3,675,463 | 7/1972 | Munschauer, Jr. et al. | 72/389 |
| 4,462,243 | 7/1984 | Richards | 72/481 |

FOREIGN PATENT DOCUMENTS

| | | | |
|---|---|---|---|
| 2844867 | 4/1980 | Fed. Rep. of Germany | 72/481 |
| 0321600 | 11/1929 | United Kingdom | 72/390 |

*Primary Examiner*—Lowell A. Larson
*Assistant Examiner*—Thomas C. Schoeffler
*Attorney, Agent, or Firm*—Learman & McCulloch

[57] ABSTRACT

A method of bending rule to be used to cut a slot as part of a box makers form comprising locating the rule tangentially of a pair of rollers and driving a former between the rollers so that the rule pivots around the rollers as it is bent.

4 Claims, 3 Drawing Sheets

BOX MAKERS FORMS

BACKGROUND OF THE INVENTION

In the manufacture of card and board cartons and boxes from blanks or a web of material, the necessary cutting and creasing is effected by so called printer's rule which has a sharpened or rounded edge, according to purpose, and is mounted edge-on to a base plate or forme. The box maker is continually making new formes to suit new box sizes or arrangements, and because each is different from the last, and usually only one is required, these are handmade by bending the selected rule to the required configuration before mounting on the forme. The rule is made to different dimensions and an appropriate one is selected according to the nature of the material to be used for the boxes.

The conventional method of bending the rule involves selecting an appropriate pair of forming tools of which one is a post like member upstanding from a base plate and the second of which has a jaw mounted for reciprocation on the base plate by a lever and crank mechanism. The rule is positioned on the post and the jaw is forced against the post with the rule interposed and this may the bend the rule for example to an angle of 30% about a radius dictated by the diameter of the post. If for example a slot is required in the box, so that two parallel cutting rule portions are to be connected by a small radius, then a post of that radius is mounted in position, and after a first forming operation bringing about a 30% bend, the part-formed rule is displaced about the post and the jaw reciprocation repeated, on a number of occasions, until the required parallel portions are so formed. These operations are relatively slow, and involve substantial physical effort, and involve much time spent interchanging components of the apparatus. The objects of the invention are to provide improvements.

SUMMARY OF THE INVENTION

According to the invention a method of bending box maker's rule comprises guiding a former for movement along a line towards a pair of abutments which are symmetrically disposed on either side of said line, and displacing said former along the line by a screw and nut mechanism so that the rule is taken between the abutments by the former.

DESCRIPTION OF THE DRAWINGS

The invention is illustrated with reference to the accompanying drawings wherein.

DESCRIPTION OF THE INVENTION

Figure 1:
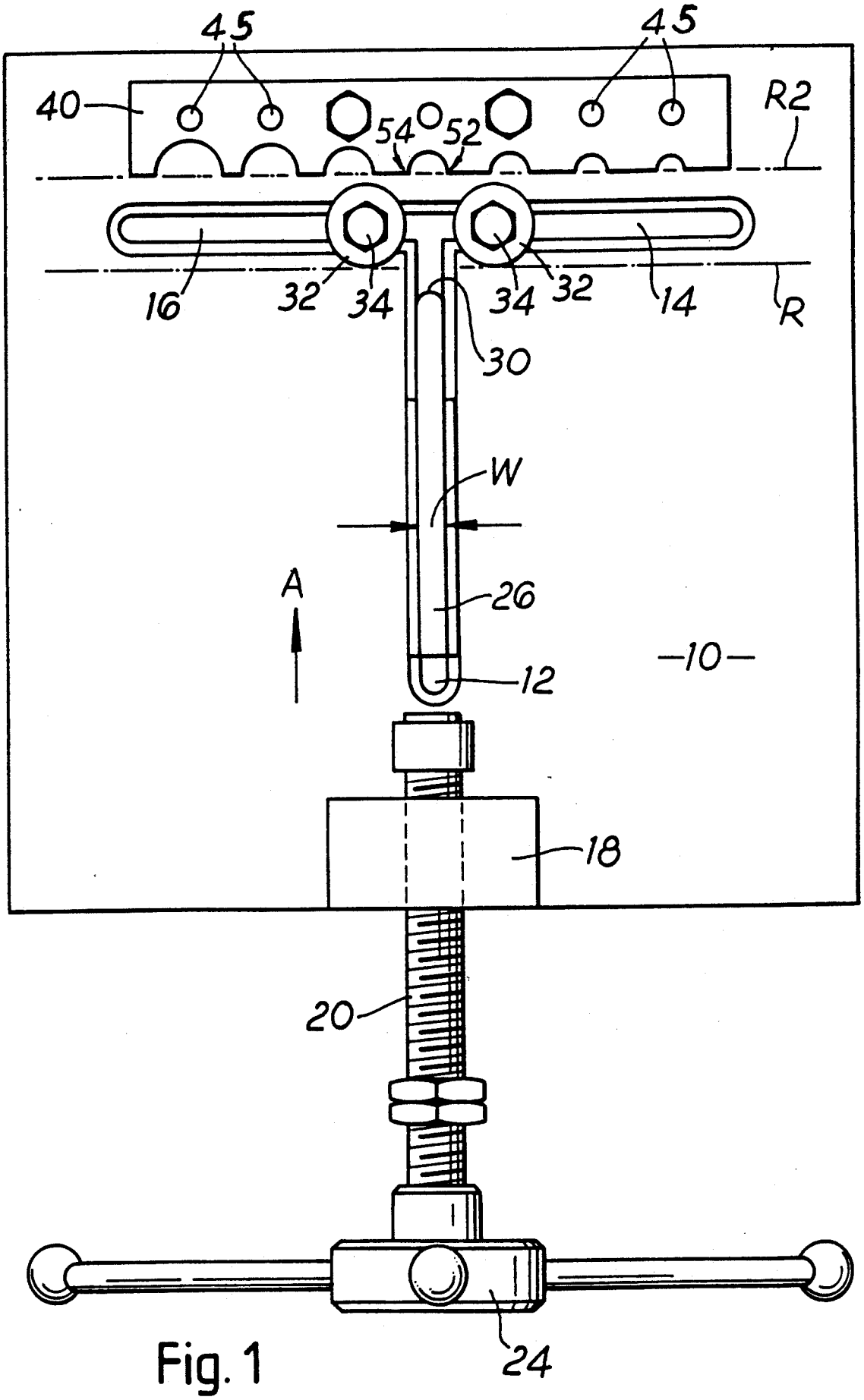
FIG. 1 is a plan view of a combination apparatus suitable for use with two different methods according to the invention.

Turning now to the drawings, the apparatus for carrying out the method comprises a table 10 formed with a Tee slot 12, 14, 16. A boss 18 is screwthreadedly engaged with machine screw 20 fast with a handwheel or like 24.

A former 26 is slidably guided in slot 12 and has a width W suitable for the slot to be cut and a nose 30 of suitable radius between the sides of the slot.

Cylindrical capstans 32, which may be fixed or rotatable, are located in the slots 14, 16 by bolts 34 so as to be equi-spaced about the axis of slot 12. They can be adjusted in the slots to different spacings for different widths.

Figure 4:
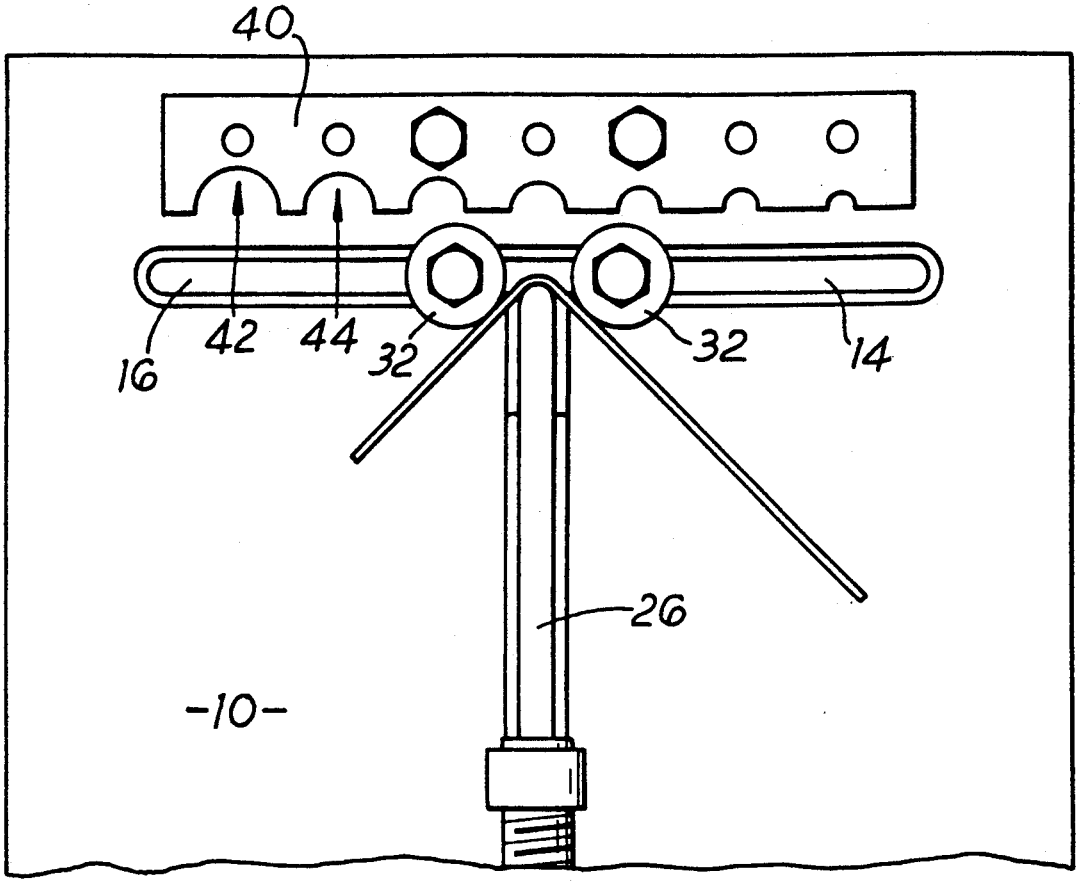
FIGS. 4 and 5 show a rule being bent, in two stages.
Figure 5:
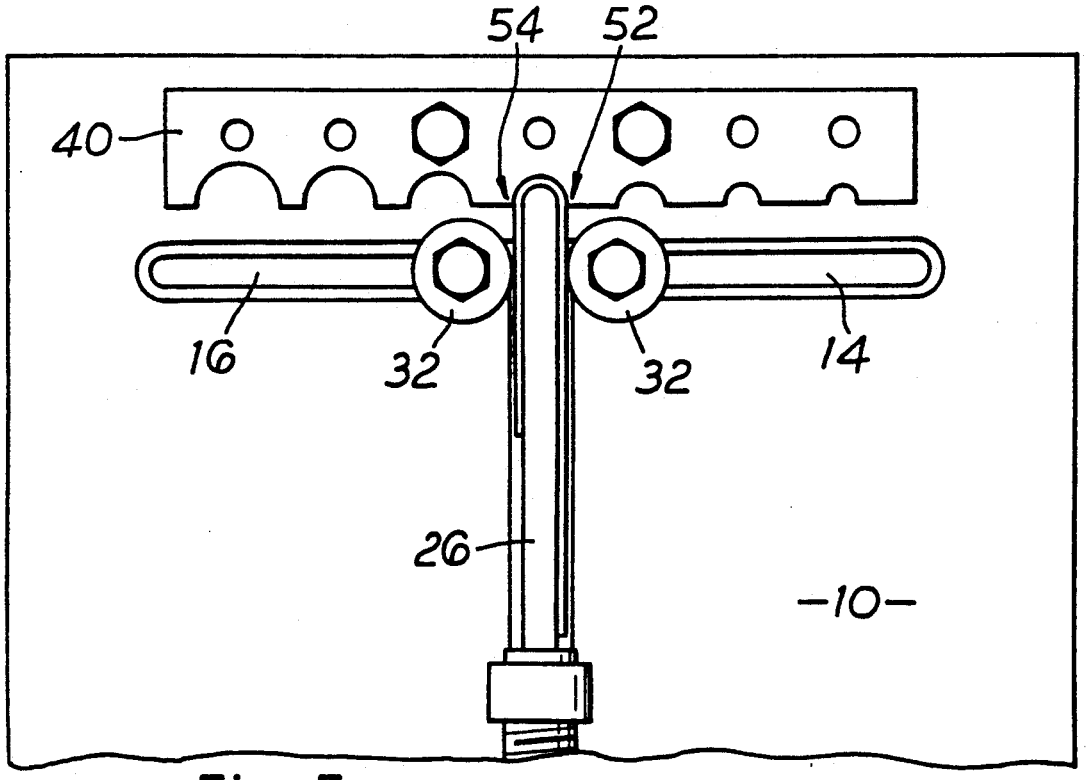

In use the selected former 26 is dropped into the slot, the capstans are adjusted in position, and the rule is located in the position R so as to extend tangentially of both capstans. Handwheel 24 advances the former in the direction of arrow A and this takes the rule into the shape shown first in FIG. 4, then FIG. 5, but in a single continuous movement. It will be seen that the distance between the rollers needs to be equal to the width W plus twice the rule thickness, together with any desired tolerance.

Mounted on the table is block 40 having a series of preferably semi-circular recesses 42, 44 of different dimensions. The block has a series of holes 45 so that it can be bolted to the table with any one recess aligned with the former. This allows the block to be used with the capstans as in FIG. 5 to perfect the shape of the rule, or alone, with the capstans removed. In this latter instance, the rule occupies the position of the chain dot line R2, and as the nose of the former contacts the rule the latter contacts the shoulders 52, 54 and both pivots and slides on those shoulders as the nose enters the recess. A complete 180° bend is achieved when the former nose radius plus the rule thickness is equal to the recess radius. A smaller angular bend, for example a 90° bend is achieved by using the same former with a larger one of the recesses.

It will be appreciated that different formers can be used either to give different width of slot, or to give different radius between successive bent portions.

Figures 2, 3:
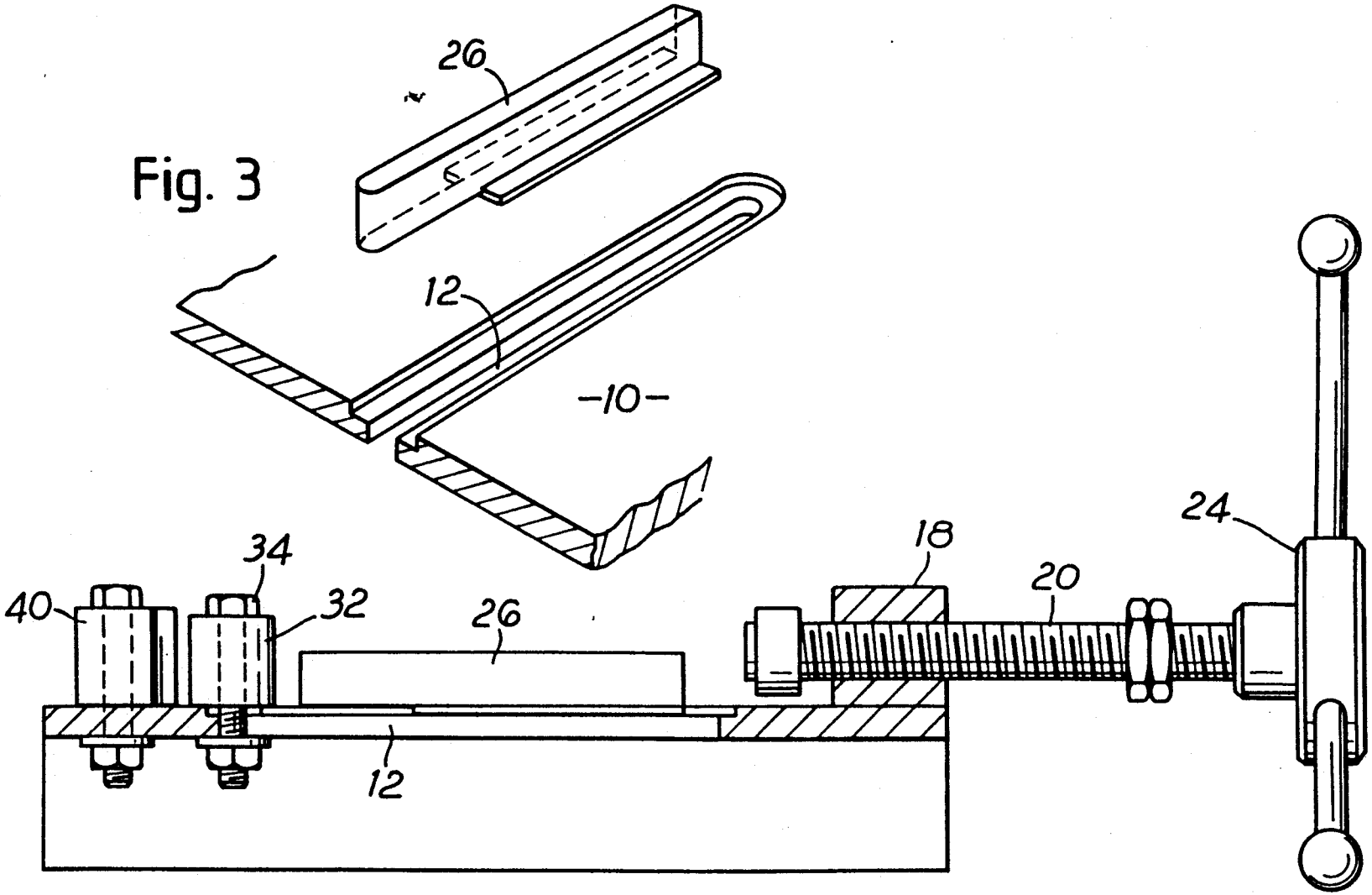
FIG. 2 is a side elevation of the same.
FIG. 3 is a fragmentary perspective view.

Each former may be of tee-section with the head of the tee cooperating with the complementary slot so as to support and guide the former for displacement generally in the plane of the base plate, with the stem of the tee-section (which is inverted) acting as the former proper, as shown in FIG. 3.

Components may be rapidly interchanged when required. The use of the screw and nut mechanism for advancing the former gives low-effort operation which can be easily controlled especially when bends of precise angular relationship are required.

I claim:

1. A method of bending a tool makers rule, comprising locating the rule tangentially of a pair of cylindrical capstans journalled on parallel axes, locating a selected forming tool in guide means on one side of said rule and a forming block provided with a plurality of recesses on the opposite side of said rule, aligning a selected recess with said guide, advancing the forming tool between said capstans and toward said forming block so that the forming tool bends the rule to wrap it about the forming tool as the forming tool and rule pass between said capstans, and perfecting the shape of the bend as the forming tool with the rule wrapped thereabout enter the selected recess.

2. The method of claim 1, including perfecting the bend as the forming tool and rule wrapped thereabout enter the selected recess, while the wrapped rule remains engaged between the capstans.

3. The method of claim 1 including configuring the forming tool to include a central arcuate end for bending the rule arcuately thereabout, and configuring the recesses to have different arcuate shapes for receiving, when aligned with said guide means, said arcuate end having said rule wrapped thereabout.

4. The method of claim 1 wherein the forming tool is advanced using screw and nut means.

* * * * *